United States Patent [19]

Bohon

[11] Patent Number: 4,997,346

[45] Date of Patent: Mar. 5, 1991

[54] WELL PUMPING SYSTEMS

[75] Inventor: William M. Bohon, Frisco, Tex.

[73] Assignee: Atlantic Richfield Company, Los Angeles, Calif.

[21] Appl. No.: 508,753

[22] Filed: Apr. 12, 1990

[51] Int. Cl.[5] ..... F04B 9/00

[52] U.S. Cl. ..... 417/319; 417/362; 417/423.6; 74/41

[58] Field of Search ..... 417/319, 362, 423.6; 74/41

[56] References Cited

U.S. PATENT DOCUMENTS

| | | | |
|---|---|---|---|
| 3,075,467 | 1/1963 | Gallaway | 417/319 |
| 3,751,192 | 8/1973 | Boyd | 60/407 |
| 3,971,213 | 7/1976 | Kelley | 60/407 |
| 4,561,827 | 12/1985 | Beaumont | 417/319 |
| 4,927,333 | 5/1990 | Kato | 417/362 |

*Primary Examiner*—Leonard E. Smith
*Assistant Examiner*—Michael Kocharov
*Attorney, Agent, or Firm*—Drude Faulconer

[57] ABSTRACT

The present invention provides a method and apparatus for eliminating at least a portion of the energy losses in a well pumping system which are due to "regeneration" (i.e. those periods during the pumping cycle in which the pumping system experiences negative net torque). This is accomplished by positioning a clutch means in the driving connection between the prime mover and the pumping unit of the well pumping system so that the clutch means forms a driving connection between said prime mover and said pumping unit during periods when said pumping unit experiences positive net torque and effectively disengages the driving connection between said prime mover and said pumping unit to allow freewheeling therebetween during periods when said pumping unit experiences negative net torque.

13 Claims, 1 Drawing Sheet

WELL PUMPING SYSTEMS

DESCRIPTION

1. Technical Field

The present invention relates to well pumping systems and in one of its preferred aspects relates to a surface pumping unit for reciprocating a string of sucker rods to operate a downhole pump wherein a means is positioned between the prime mover and the unit whereby the prime mover is only in effective driving engagement with the pumping unit during those periods of the pumping cycle in which the pumping unit experiences positive net torque.

2. Background Art

Reciprocating downhole pumps are universally known for lifting fluids , e.g. oil, water, etc., from wells. Typically, the pump is positioned downhole adjacent the producing formation and is operated by a string of sucker rods which extend to the surface. The sucker rod string is reciprocated by a surface "pumping unit" which is typically comprised of a walking beam that is rocked about a pivot by a pitman arm to alternately move the sucker rod string up and down. The pitman is driven by a prime mover, usually through a gearbox, and converts rotary motion from the gear box into the reciprocating motion required by the pitman arm to operate the walking beam. It is estimated that pumping units of this type are used on about 85 per cent of all artificially lifted (i.e. pumped) wells in the world.

While sucker rod pumping units are considered to be the most energy efficient means of artificial lift, they are still highly inefficient in terms of the actual amounts of energy consumed. That is, studies have shown that sucker rod pumping units have an energy efficiency of about only 50 per cent. For example, where the prime mover for a sucker rod pumping unit is an electric motor, only about half of the electric power consumed is converted into hydraulic horsepower with the rest being lost as friction or other inefficiencies. One such inefficiency is that which is associated with the recently recognized phenomenon of "regeneration".

The well load (i.e. load being lifted and lowered by the pumping unit) exerts torque on the gearbox of the unit as do the counterweights normally present in such units. The well load torque and the counterbalance torque oppose each other but, unfortunately, never completely cancel each other, even when the unit is "properly balanced" in accordance with accepted engineering practices. The difference between these two torques (hereinafter called "net torque") is the torque which is exerted on the prime mover (e.g. electric motor, internal combustion engines, etc.). During most of the pumping cycle, the net torque is positive which acts to slow the unit down. During these periods of positive net torque, the prime mover must drive the unit in order to keep the unit running and must draw power from its energy source (e.g. an electric motor functions as a motor, consuming electricity). During period of negative net torque, the pumping unit drives the prime mover which acts as to slow the prime mover down (e.g. an electric motor functions as a generator to deliver electric power back to the grid while an internal combustion engine acts a brake on the unit). The period of negative net torque is known as "regeneration" and regardless of the type of pumping unit, occurs at least once (sometime twice) during each pumping cycle.

During the positive torque periods of the pumping cycle, the prime mover supplies more energy to the system than is needed to complete one pump cycle. This is an inherent result of the kinematics of pumping units and is not a function of the size of the prime mover. During the negative torque periods, i.e. regeneration, the excess energy is returned or otherwise dissipated into heat or work. However, each time energy is converted from one form to another, there is an inherent loss due to inefficiency in the conversion. For example, an electric motor of the type normally used to power a typical sucker rod pumping unit has an energy efficiency of about 85 per cent. If the "excess" energy is input to the system at an electrical-to-mechanical efficiency of 85 per cent and is regenerated at a mechanical-to-electrical efficiency of 85 per cent, then only 70 per cent ($0.85 \times 0.85 = 0.7$) of the excess electrical power drawn from the grid is recovered.

Regeneration has only recently been recognized as a significant factor in pumping unit inefficiency and is still not widely understood. At least one technique has been proposed for reducing the inefficiency of pumping units which results from regeneration, see "Power Savings and Load Reductions on Sucker Rod Pumping Wells", SPE 19715, A.B. Neely et al, presented at the 84th Annual Tech Conference of the Society of Petroleum Engineers, San Antonio, TX, Oct. 8–11, 1989. As described in this paper, a "soft start" SCR motor controller was installed on an electric motor of a large sucker rod pumping unit and was used to rapidly turn the motor on and off. The motor was turned on only during those portions of the pumping cycle when the motor was normally heavily loaded and thus operating efficiently. A motor is usually not loaded heavily during regeneration. It was discovered that by turning the motor on and off at selected times during the pumping cycle, either peak loads or power consumption could be reduced. More specifically, it was found that minimum power usage occurred when the power was left off only during the negative power periods (regeneration) which resulted in a reduction in the net power used of from 5 to 10 per cent. While this technique for alleviating regeneration losses during a pumping cycle appears promising, the costs of electronic motor controllers are high and the operational life of such controllers in this environment is unknown and is likely to be short.

DISCLOSURE OF THE INVENTION

The present invention provides a method and apparatus for eliminating at least a portion of the energy losses in a well pumping system which are due to "regeneration" (i.e. those periods during the pumping cycle in which the pumping system experiences negative net torque). This is accomplished by positioning a clutch means in the driving connection between the prime mover and the pumping unit of the well pumping system. The clutch means forms a driving connection between said prime mover and said pumping unit during periods when said pumping unit experiences positive net torque and effectively disengages the driving connection between said prime mover and said pumping unit during periods when said pumping unit experiences negative net torque.

More specifically, the present well pumping system is comprised of a support on which a walking beam is pivotably mounted. A string of sucker rods is supported from one end of the walking beam while a pitman arm connects the other end to a crankarm which is mounted on the output shaft of a gearbox. Counterweights are mounted on the crankarm to "balance" the pumping unit. The input shaft of the gearbox has a sheave thereon which is driven by a belt that also passes around a sheave which is positioned on the output shaft of a prime mover.

A clutch means, e.g. overrunning clutch, is positioned between the output shaft of the prime mover and the sheave which is positioned thereon so that when the pumping unit is experiencing positive net torque, the clutch will lock the sheave to the output shaft to form a driving connection between the prime mover and the pumping unit. However, when the pumping unit experiences negative net torque, the clutch allows the sheave to "overrun" and rotate faster than the output shaft, thereby effectively disengaging the sheave from the shaft and eliminating "regeneration" losses normally experienced during these periods.

The present invention is applicable with different prime movers such as electric motors or internal combustion engines. Tests with electric motors as prime movers have demonstrated that the elimination of regeneration can reduce the electric energy consumption of a typical sucker rod pumping system from 5 to 10 per cent, which can be a substantial economic consideration, especially in fields where there are many such pumping systems.

BRIEF DESCRIPTION OF THE DRAWINGS

The actual construction, operation, and the apparent advantages of the present invention will be better understood by referring to the drawings in which like numerals identify like parts and in which.

BEST MODE FOR CARRYING OUT THE INVENTION

Figure 1:
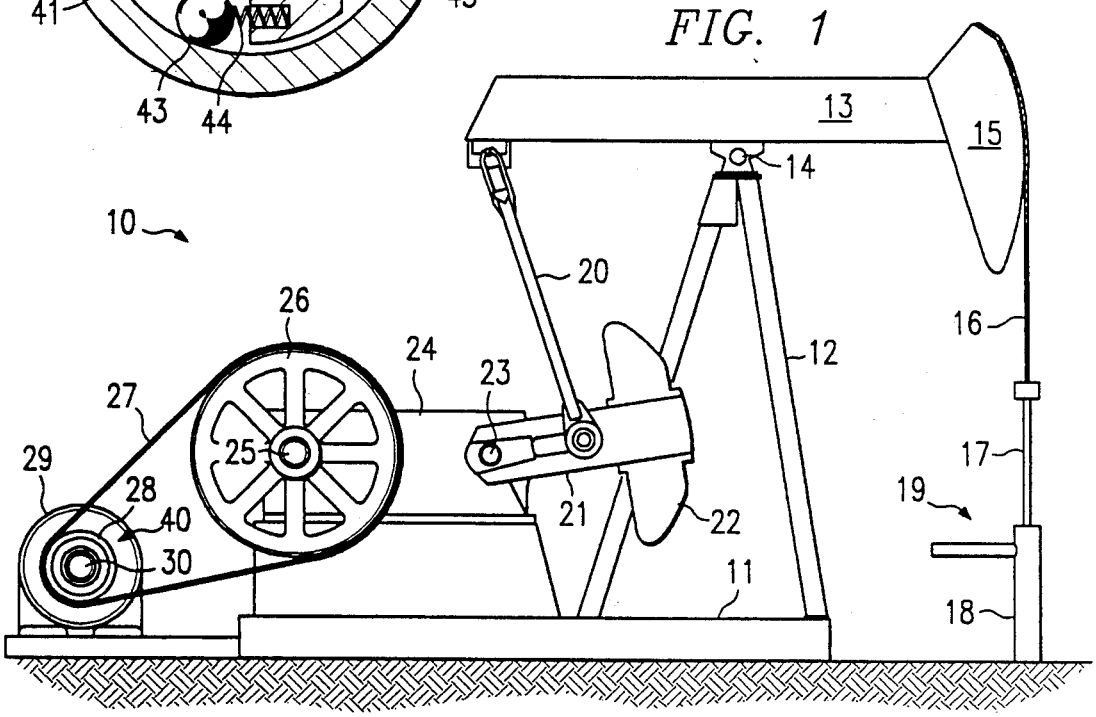
FIG. 1 is an elevation view of a typical sucker rod pumping unit incorporating the present invention.

Referring more particularly to the drawings, FIG. 1 discloses a pumping system comprising rod pumping unit 10 in accordance with the present invention. Unit 10 is comprised of base 11 having a support, e.g. Samson post 12 on which walking beam 13 is pivoted on axis 14. Walking beam 13 has a horsehead 15 at one end which is connected to a polished rod 17 by support hanger 16. As will be understood, polished rod 17 passes through stuffing box 18 on wellhead 19 and is connected to a string of sucker rods (not shown) which, in turn, operate a downhole pump.

Pitman arm(s) 20 couple the other end of walking beam 13 to crankarm(s) 21 which have counterweights 22 mounted thereon. Crankarm 21 is mounted on and is rotated by output shaft 23 of gearbox 24 which, in turn, is driven by input shaft 25. Flywheel 26 is mounted on input shaft 25 and has a sheave thereon. Belt 27 passes around the sheave on flywheel 26 and around sheave 28 on output shaft 30 of prime mover 29 (e.g. electric motor, internal combustion engine, etc.) to provide power to unit 10.

The structure described to this point is well known and is representative of many different, commercially-available pumping units. As will be understood, when unit 10 is operating, prime mover 29 runs constantly, ideally at a constant speed, to drive crankarm 21 through gearbox 24 to reciprocate walking beam 13 which alternately raises (i.e. upward stroke) and lowers (downward stroke) the well load (i.e. sucker rods, well fluids, etc.). The well load exerts torque on gearbox 24 as the load is raised and lowered. Counterweights 22 also exert torque on gearbox 24 but ideally are 180° out of phase with the well load. While these torques oppose each other, unfortunately, they do not completely cancel each other, even when unit 10 is "balanced" in accordance with accepted engineering practices.

Figure 2:
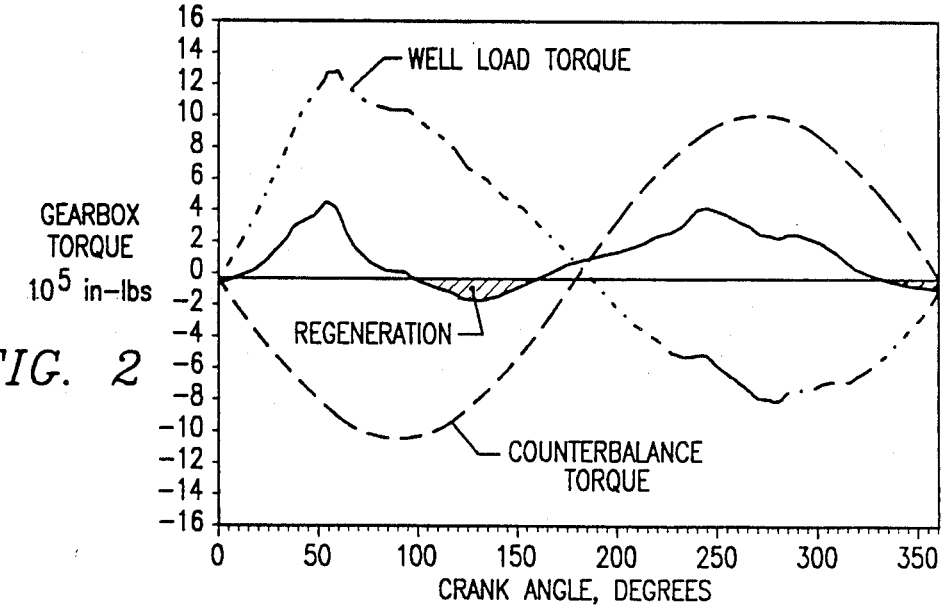
FIG. 2 is a graph illustrating the torque curves experienced by the gearbox of a typical sucker rod pumping unit during a routine pumping cycle.

The actual torques encountered during one complete pumping cycle of an actual pumping unit are shown in the graph of FIG. 2. and, as seen, are approximately sinusoidal with the "net" torque being equal to the sum of the well load torque and the counterweight torque and is the load which is actually exerted on prime mover 29. Referring more particularly to FIG. 2, it can be seen that the net torque is positive during most of the pumping cycle, this torque acting to slow the prime mover down. During these positive torque periods, the prime mover 29 must function as a motor to provide the power necessary to keep unit 10 going. This requires the prime mover to use or draw power from its energy source. During periods of net negative torque (called "regeneration"), the pumping unit 10 speeds up and the prime mover 29 functions as a generator to return power back to a grid where the prime mover is an electric motor or acts as a brake to dissipate the excess "power" as heat or work.

During the positive torque periods of the pumping cycle, the prime mover 29 delivers more energy to the system than is needed to complete one cycle. This is an inherent result of the kinematics of pumping units of this type and is not a function of the size of the prime mover. During the negative torque periods, this excess energy is recovered or is dissipated. Unfortunately, each time energy is converted from one form to another, there is a loss due to the inefficiency in the conversion. For example, electric motors of the type typically used to power pumping units such as unit 10 have energy efficiencies of about 85 per cent. That is, if the excess energy drawn by prime mover 29 has a electrical-to-mechanical conversion efficiency of 85 per cent and is "regenerated" at a mechanical-to-electrical conversion efficiency of 85 per cent, then only 70 per cent ($0.85 \times 0.85 = 0.70$) of the excess energy is returned. The remaining 30 per cent is lost due to motor/generator inefficiency. In the case of an internal combustion engine, obviously none of the energy given up by the pumping unit during regeneration can be converted back into fuel so virtually all of this energy is lost due to the braking action of the engine.

Figure 3:
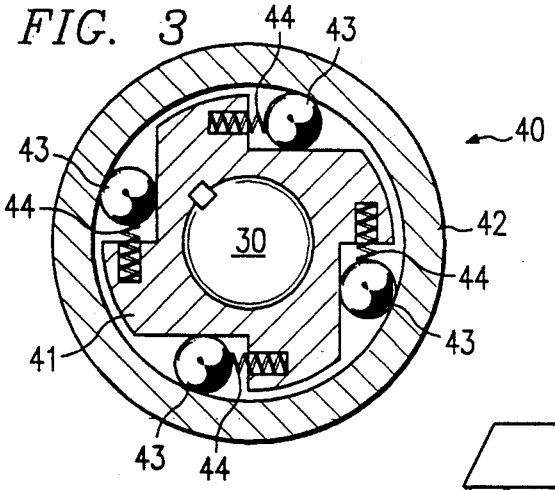
FIG. 3 is a sectional view of a typical overrunning clutch which is useful in carrying out the present invention.

In accordance with the present invention, at least a portion of the energy lost due to the regeneration phenomenon in unit 10 is eliminated by incorporating a clutch device into the pumping system between the prime mover and the pumping unit wherein the prime mover is effective only in driving engagement with the pumping unit 10 during the periods of positive net torque and is effectively disengaged during periods of negative net torque. As used herein, "clutch" device is intended to include any device or means which is capable of (1) forming a driving connection between a driving shaft and a driven member when the driving shaft is rotating at a set speed which is approximately equal to the rotational speed of the driven member and (2) allowing the driven member to free-wheel with respect to the driving shaft when the driven member rotates at a speed greater than that of the driving shaft. The clutch device is one which functions similarly to a ratchet mechanism. A typical example of such a clutch device is an overrunning clutch 40 such as the one illustrated in FIG. 3 which is also sometimes referred to as a sprag or one-way clutch.

Overrunning clutch 40 is comprised of an inner race 41 and an outer race 42. Inner race 41 is mounted on output shaft 30 (FIG. 1) of prime move 29 while outer race 42 is affixed to sheave 28. Inner race 41 has a plurality of wedge elements (e.g. ball bearings 43) positioned within recesses therein which are biased outward by springs 44. When outer race is rotated in one direction with respect to the inner race (counterclockwise in FIG. 3), it will overrun the wedge elements and will turn freely with respect to the shaft. However, when the outer race is rotated in the opposite direction (clockwise) with respect to the inner race, the wedge elements will lock the outer race to the inner race to be driven thereby. This type of overrunning clutch is well know and is commercially available; e.g. Cam and Roller-Ramp Clutches, Morse Industrial, Emerson Power Transmission Corp., Ithaca, N.Y.

Overrunning clutch 40 is oriented between shaft 30 of prime mover 29 and sheave 28 such that during the positive net torque periods of the pumping cycle, clutch 40 is locked or engaged allowing prime mover 29 to drive pumping unit 10. However, during the negative net torque periods of the pumping cycle, the clutch free-wheels allowing the sheave 28 to speed up with respect to shaft 30 to prevent pumping unit 10 from driving the prime mover 29 as a generator (where it is an electric motor) or to prevent prime mover 29 from acting as a brake (where it is an internal combustion engine). With regeneration thus eliminated, the speed variations within a pumping cycle will be greater and the pumping unit 10 will operate at a slightly faster average speed (strokes per minute).

These speed variations in the present invention can be minimized by increasing the rotation inertia of flywheel 26. On newly manufactured pumping units, a larger-diameter or width sheave can be originally installed onto the input shaft of gearbox 24. On existing pumping units, it is possible to change out the gearbox sheave but is difficult and instead it may be preferable to simply clamp weights to the rim of the existing sheave.

The speed of a pumping unit (strokes per minute) equipped with a clutch device in accordance with the present invention can be adjusted by varying the size of the sheave 28 on the output shaft of prime mover 29 in the same manner as is done in conventional units. To run at the same strokes per minute, a pumping unit retrofitted with a clutch device would simply require a slightly smaller prime mover sheave 28.

What is claimed is:

1. A well pumping system comprising:

a pumping unit for reciprocating a string of rods upward and downward in a well;

a prime mover; and clutch means for forming a driving connection between said prime mover and said pumping unit during periods when said pumping unit experiences positive net torque and for effectively disengaging the driving connection between said prime mover and said pumping unit during periods when said pumping unit experiences negative net torque.

2. The well pumping system of claim 1 wherein said clutch comprises:

an overrunning clutch.

3. The well pumping system of claim 1 wherein said pumping unit includes:

a gearbox having an input shaft;

said prime mover having a output shaft;

drive means for connecting said output shaft of said prime mover to said input shaft of said gearbox; said drive means including said clutch means.

4. The well pumping system of claim 3 wherein said drive means comprises:

a sheave mounted on said input shaft of said gearbox;

a sheave positioned on said output shaft of said prime mover;

a belt positioned around said sheaves; and said clutch means positioned between said output shaft of said prime mover and said sheave positioned on said output shaft of said prime mover.

5. The well pumping system of claim 4 wherein said prime mover is an electric motor.

6. The well pumping system of claim 4 wherein said prime mover is an internal combustion engine.

7. A well pumping system comprising;

a pumping unit comprising:

a support;

a walking beam pivotally mounted on said support;

a string of sucker rods supported from one end of said walking beam;

a gearbox having an input shaft and an output shaft;

a crankarm mounted on said output shaft of said gearbox;

a pitman arm connecting said crankarm to the other end of said walking beam;

a counterweight mounted on said crankarm;

a prime mover having an output shaft; and drive means for connecting said output shaft of said prime mover to said input shaft of said gearbox; said drive means including:

clutch means for forming a driving connection between said output shaft of said prime mover and said input shaft of said gearbox unit during periods when said pumping unit experiences positive net torque and for effectively disengaging the driving connection between said output shaft of said prime mover and said input shaft of said gearbox during periods when said pumping unit experiences negative net torque.

8. The well pumping system of claim 7 wherein said clutch means comprises:

an overrunning clutch.

9. The well pumping system of claim 7 wherein said drive means comprises:

a sheave mounted on said input shaft of said gearbox;

a sheave positioned on said output shaft of said prime mover;

a belt positioned around said sheaves; and said clutch means positioned between said output shaft of said prime mover and said sheave positioned on said output shaft of said prime mover.

10. The well pumping system of claim 9 wherein said prime mover is an electric motor.

11. The well pumping system of claim 9 wherein said prime mover is an internal combustion engine.

12. A method of eliminating regeneration in the pumping cycle of a well pumping system having a pumping unit and a continuously-running prime mover, the method comprising:

providing a driving connection between said continuously-running prime mover and said pumping unit only during those periods of said pumping cycle in which said pumping unit experiences positive net torque; and effectively disengaging the driving connection between said continuously-running prime mover and said pumping unit only during those periods of said pumping cycle in which said pumping unit experiences negative net torque.

13. The method of claim 12 wherein said prime mover includes an output shaft and a shave positioned on said output shaft and wherein said step of effectively disengaging the driving connection comprises:

allowing said sheave to freewheel on said output shaft during said periods of negative net torque.

* * * * *